US007213849B2

(12) United States Patent
Weinberg et al.

(10) Patent No.: US 7,213,849 B2
(45) Date of Patent: May 8, 2007

(54) FITTING

(75) Inventors: Andreas Weinberg, Stuttgart (DE); Martin Ruf, Tuebingen (DE)

(73) Assignee: Dorma GmbH + Co., KG, Ennepetal (DE)

( * ) Notice: Subject to any disclaimer, the term of this patent is extended or adjusted under 35 U.S.C. 154(b) by 110 days.

(21) Appl. No.: 10/507,457

(22) PCT Filed: Mar. 11, 2003

(86) PCT No.: PCT/EP03/02449

§ 371 (c)(1),
(2), (4) Date: Sep. 10, 2004

(87) PCT Pub. No.: WO03/076746

PCT Pub. Date: Sep. 18, 2003

(65) Prior Publication Data

US 2005/0110282 A1 May 26, 2005

(30) Foreign Application Priority Data

Mar. 11, 2002 (DE) ..... 102 10 479

(51) Int. Cl.
*E05B 1/00* (2006.01)
*E05F 5/02* (2006.01)

(52) U.S. Cl. ..... 292/336.3; 16/82; 16/417; 70/432; 292/347; 292/DIG. 2; 292/DIG. 8; 292/DIG. 19

(58) Field of Classification Search ..... 70/432, 70/DIG. 59, 332, 445, DIG. 58; 16/82, 412; 292/336.3, DIG. 2, 347, 350, 351, DIG. 8, 292/DIG. 15, DIG. 19, DIG. 63
See application file for complete search history.

(56) References Cited

U.S. PATENT DOCUMENTS

| | | | | | |
|---|---|---|---|---|---|
| 197,910 | A | * | 12/1877 | Taylor | 70/86 |
| 2,140,239 | A | * | 12/1938 | Lewis | 16/86 A |
| 2,149,375 | A | * | 3/1939 | Wiebe | 292/347 |
| 2,160,611 | A | * | 5/1939 | Alexander | 292/348 |
| 4,223,931 | A | * | 9/1980 | Neary | 292/347 |
| 4,248,068 | A | * | 2/1981 | Esser et al. | 70/134 |
| 4,559,796 | A | * | 12/1985 | De Forrest, Sr. | 70/432 |
| 6,289,557 | B1 | * | 9/2001 | Manson et al. | 16/412 |
| 6,536,592 | B1 | * | 3/2003 | Chang et al. | 206/459.1 |

FOREIGN PATENT DOCUMENTS

| | | | |
|---|---|---|---|
| DE | 94 02 836 U1 | | 8/1995 |
| DE | 296 19 036 U1 | | 2/1997 |
| DE | 29707200 | * | 7/1997 |
| EP | 0 774 555 A2 | | 5/1997 |
| GB | 432631 | | 7/1935 |
| GB | 2183712 | * | 6/1987 |

* cited by examiner

*Primary Examiner*—Lloyd A. Gall
(74) *Attorney, Agent, or Firm*—Cohen Pontani Lieberman & Pavane LLP

(57) ABSTRACT

A hardware fitting for an all-glass door, including a first fitting half arrangeable on an outer side of the door, a second fitting half arrangeable on an inner side of the door, an actuatable nut arranged between the first and second fitting halves, a lock having a locking bolt and arranged between the first and second fitting halves, and a door stop integrated into at least one of the first and second fitting halves. The locking bolt is slidable between a retracted and an extended position in response to a movement of the nut.

20 Claims, 5 Drawing Sheets

FITTING

PRIORITY CLAIM

This is a U.S. national stage of application No. PCT/EP03/02449, filed on Mar. 11, 2003. Priority is claimed on that application and on the following application(s): Country: Germany, Application No.: 102 10 479.4, Filed: Mar. 11, 2002.

BACKGROUND OF THE INVENTION

1. Field of the Invention

The invention pertains to a hardware fitting for a glass door, the fitting including two halves.

2. Description of the Prior Art

Hardware fittings for glass doors are used primarily for the doors of baths, showers, changing rooms, etc. These fittings have either pushbuttons or a knob. Inside the front plate of the fitting is a means of displaying information, which tells the person approaching a door of this type whether the door is open or has already been locked from the inside. These types of "occupied" or "unoccupied" signs are designed with another button next to the pushbutton. The additional button travels outward upon rotation of the locking bolt of the lock and simultaneously rotates a disk, which conveys the information to the outside that the booth is occupied. In these types of locks, a latch is also provided in addition to the bolt; this latch is actuated by the pushbuttons, which act by way of a nut.

SUMMARY OF THE INVENTION

An object of the present invention is to provide an aesthetically attractive hardware fitting for a glass door, which serves several functions in the smallest possible space and which can also be manufactured at low cost.

This task is accomplished by a hardware fitting for a glass doors comprising two halves, with a lock having a locking bolt arranged between the two halves. The locking bolt is slidable inward and outward by a nut. Furthermore, a doorstop is integrated into at least one of the two halves.

According to the invention, a hardware fitting is proposed which consists essentially of two opposing halves, between which a lock is integrated, and which also has a stop for the door integrated into at least one of the two halves of the fitting. Each of the two halves can consist of, for example, a knob, the external form of which can be adapted aesthetically to the circumstances in question. A knob consists preferably of a round (cylindrical) component, the outward-projecting external surface of which has a certain slant. The knob that is on the outside, for example, is designed so that it has a gripping recess underneath, so that the door can be more easily pulled by the user. In addition, an emergency opening is provided inside a central bore, so that, in an emergency, a door of this type can also be opened from the outside.

The knob that is inside the closed booth also has a slanted outer surface. In contrast to the outside knob, the inside knob can be rotated, so that a locking bolt can be pushed out or pulled in by way of a nut. The locking bolt is located between the two halves of the fitting and is covered in the direction toward the edge of the door by plates on the two halves of the fitting. The locking bolt is designed as a two-stage bolt, which cooperates with a nut, which has two drivers and a stop. This stop acts on the bolt when the bolt is being pulled in. As a result of the two-stage design of the tailpiece of the bolt, the bolt is pushed out of the housing of the hardware fitting by the first driver when the knob is rotated. The second driver of the nut is designed to contact the driver of the second stage of the tailpiece and thus simultaneously has the effect of making the bolt self-locking with respect to deliberate attempts to push it back in the opposite direction.

The outer area of the inside knob is designed to consist of two different materials. One of these materials has a much lower Shore hardness than the other material. The material with the low Shore hardness, which can be a rubbery compound, for example, can be integrated into the knob either as a coating or as a separate component. For aesthetic reasons, it has been found that the projecting area of the slanted edge should extend up to about the middle of the knob. The material with the lower Shore hardness means that this half of the fitting simultaneously acts as a stop for the door against the wall located behind it.

So that the knob can be rotated more conveniently, the knob has projections on at least part of its outer circumference, which make it easy to grip and turn the knob.

The two halves of the hardware fitting are connected to each other by locating pins, which center the two halves on each other. The two halves are then tightened against each other in both a positive and nonpositive manner by a locking screw in such a way that the locking bolt is still able travel in and out easily in the middle area of the fitting.

Whereas the outside knob is connected permanently to the plate and thus to the one half of the fitting, the inside knob is designed to be installed positively on a square driver and locked in place from the outside by a fastening screw.

Inside the plates of the fitting, there is a display device, which tells the user both inside and outside the booth whether the door to which it is attached is locked or not. The display indicator consists of areas on the locking bolt, e.g., a green area for the unoccupied state and a red area for the occupied state.

The hardware fitting can be produced preferably of brass, light metal, special steel, or plastic.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
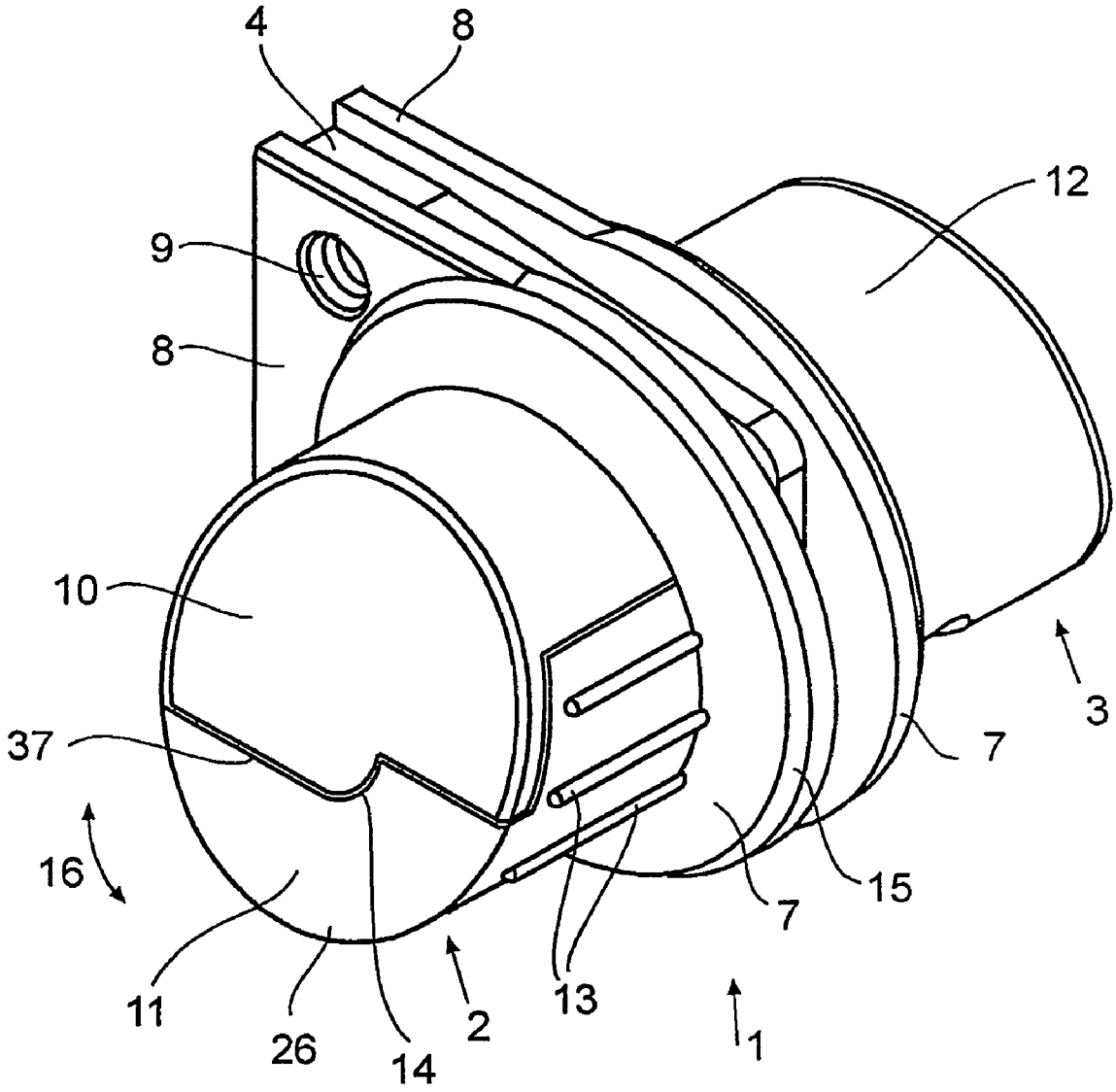
FIG. 1 is a perspective view of a hardware fitting, where the half of the fitting which is located inside the space to be closed off is facing forward.
Figure 2:
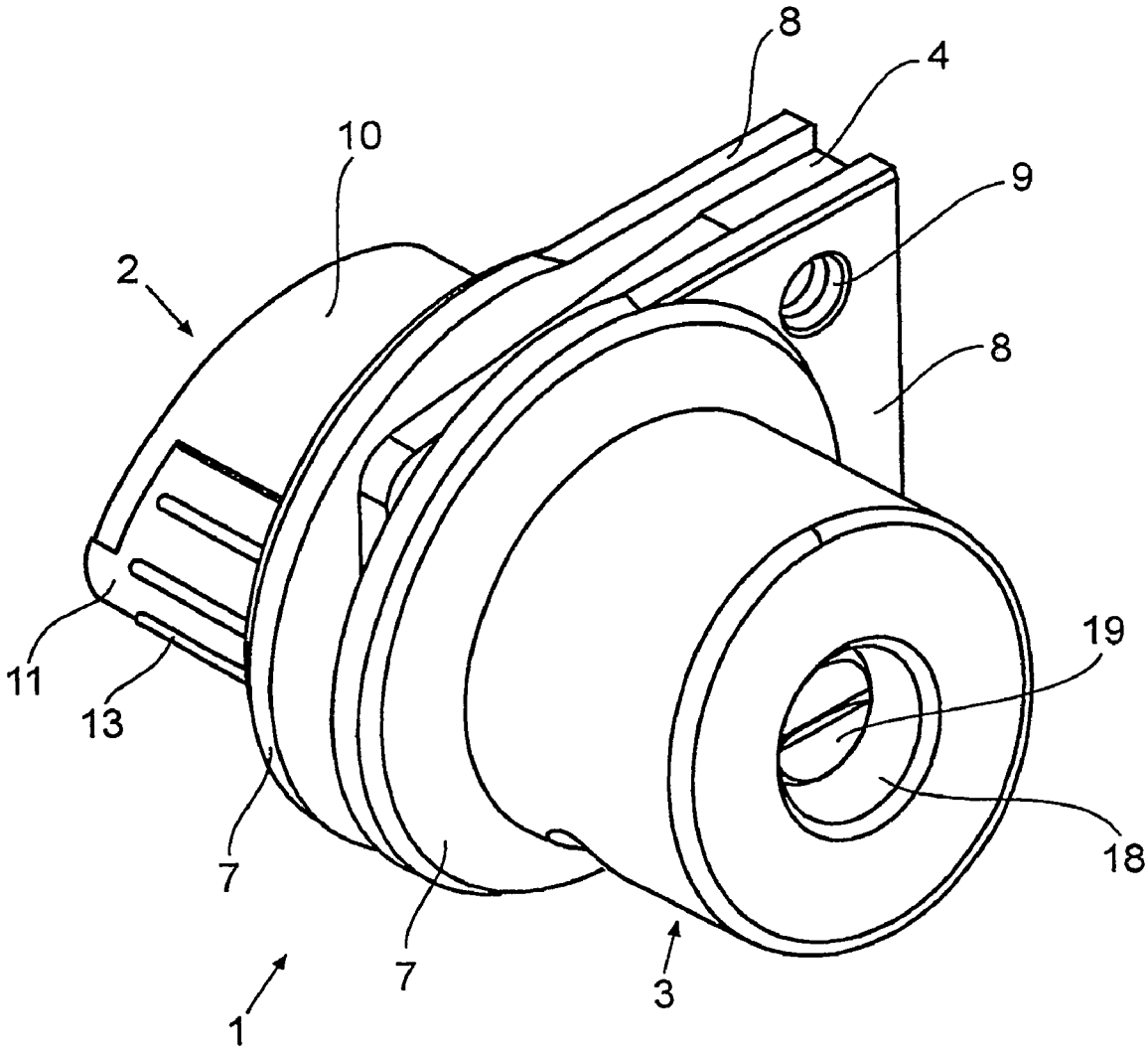
FIG. 2 is a perspective view of the hardware fitting of FIG. 1, where the half which faces the outside can be seen in the foreground.

FIG. 1 shows a hardware fitting 1 according to the invention, which consists essentially of a fitting half 2 (attached to the inside surface of the door) and a fitting half 3 (attached to the outside surface of the door). In the exemplary embodiment of FIG. 1, the gripping elements of the two halves 2, 3 are designed as knobs.

The inside knob consists of an upper knob part 10 and a lower knob part 11. These two knob parts 10, 11 have different Shore hardnesses, the lower knob part 11 having the lower Shore hardness. The lower knob part 11 has a projecting area, which is used as a stop 26 (see FIG. 3) for the door. The outside knob 12 and the inside knob with its knob parts 10 and 11 are designed as cylindrical components The division between the two different materials of the inside knob is shown by a corresponding joint line 37, wherein the joint line 37 has an offset 14 for aesthetic reasons. On the cylindrical circumference, the material with the lower Shore hardness extends beyond the circumference of the knob and is provided with projections 13. These make it easier to grip the inside knob when it is to be turned in the directions of the arrow 16 to actuate the locking bolt. So that the knob perform its function when rotated, a recess is located inside the knob, which can be mounted positively on a driver 25, which works together with the nut. The fitting half 2 is secured to the driver 25 by a fastening screw 27, which is screwed against the driver 25.

Figure 3:
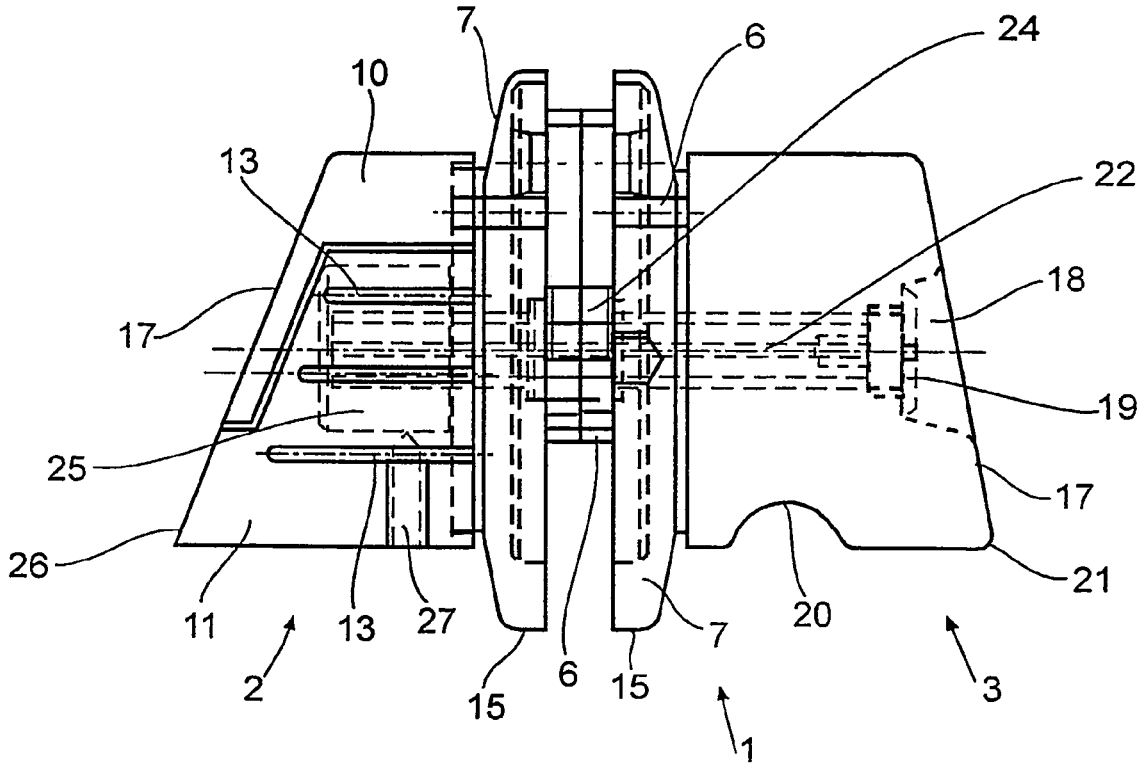
FIG. 3 is a side view of the hardware fitting according to FIGS. 1 and 2.

It is clear from FIG. 3 that the two halves 2, 3 of the fitting rest against rosettes or circular flanges 7, which have a bevel 15 in their outer circumferential area. FIG. 3 also shows that the outer surfaces 17 of the two halves, 2, 3 of the fitting are slanted. This is important especially for the integrated stop 26. Because of its lower Shore hardness, the stop 26 can damp the impact which occurs when the fitting half 2 meets the wall. The rosettes 7 of the two halves 2, 3 of the fitting have lateral plates 8, through each of which a hole 9 passes. The hole 9 serves as a display device to show whether the booth behind the door is occupied or not. For this purpose, markings such as colored areas can be provided on a locking bolt 4. When the locking bolt 4 is extended, therefore, a "red" display field 29 is seen. When the locking bolt 4 is retracted, however, a "green" display field 28 becomes visible.

In contrast to the fitting half 2, the fitting half 3 is not connected rotatably to the other components, specifically to the nut. The fitting half 3 is designed again as a cylindrical component, which also has a slanted outer surface 17. Nevertheless, two different materials are not used. So that the fitting half 3 can be gripped more effectively, a recess 20 is provided, preferably underneath, so that the door can be pulled more conveniently.

Centered in the fitting half 3 there is a bore 18, through which a screw in the form of a connecting mandrel 22 passes. Whereas one end of the connecting mandrel 22 has a square head, which engages in the nut 24, the other end has a device 19, which makes an emergency opening possible. This can be, for example, a recess, designed in the form of a slot, so that for example, a tool can be used to open the bolted door in an emergency. The plate 8, through which the hole 9 passes, is also located on the fitting half 3 on this side. The plate can thus function again as a display device in conjunction with the display fields 28, 29 on the locking bolt 4.

Figure 4:
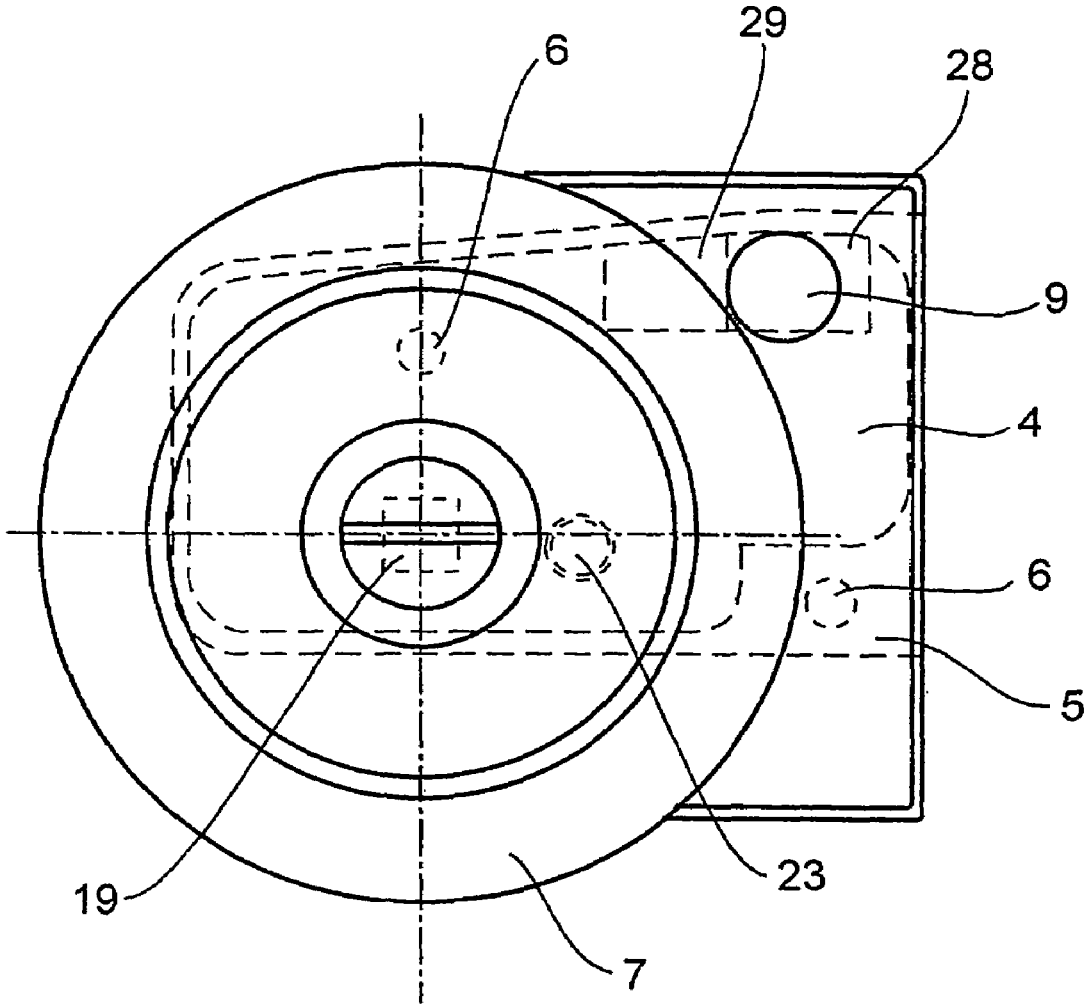
FIG. 4 is a view of the outside-facing half of the hardware fitting with its installed locking bolt, seen from the outside.

The way in which the locking bolt 4 is installed in the hardware fitting 1 can be seen in FIG. 4. FIG. 4 also shows that locating pins 6 extend from the one half 2, for example, and engage in the other half 3. The locating pins 6 are driven permanently into one or the other of the two halves 2, 3 and can be inserted loosely in the other half. As a result, the two halves of the fitting are centered and aligned inside a cutout in the glass (i.e., in the door, not shown). The two halves 2, 3 are connected by a locking screw 23, which is preferably not on the axis of the nut 24.

Figure 5:
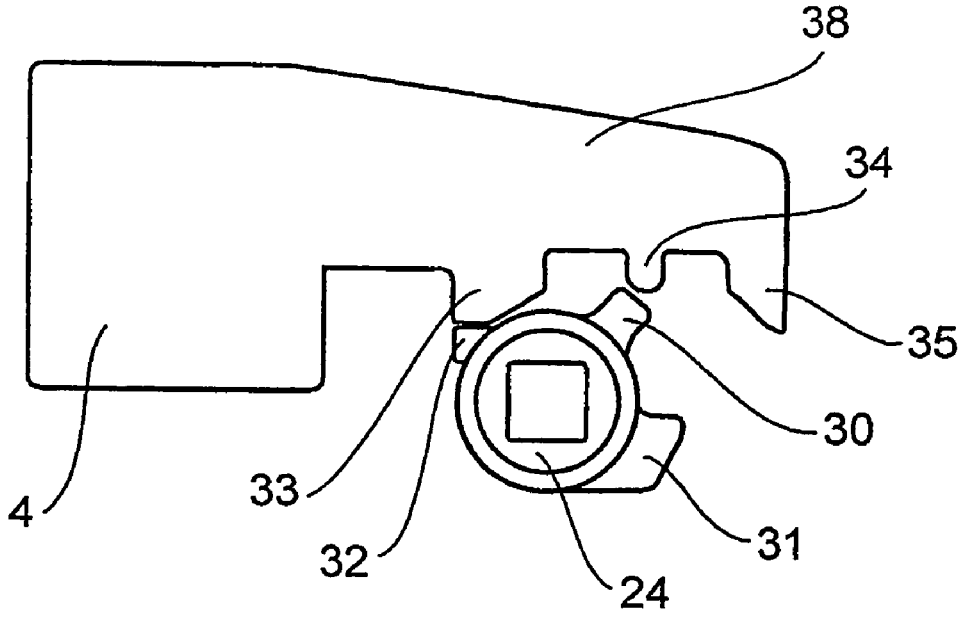
FIG. 5 is a view of the locking bolt and associated nut in the retracted position of the locking bolt.
Figure 6:
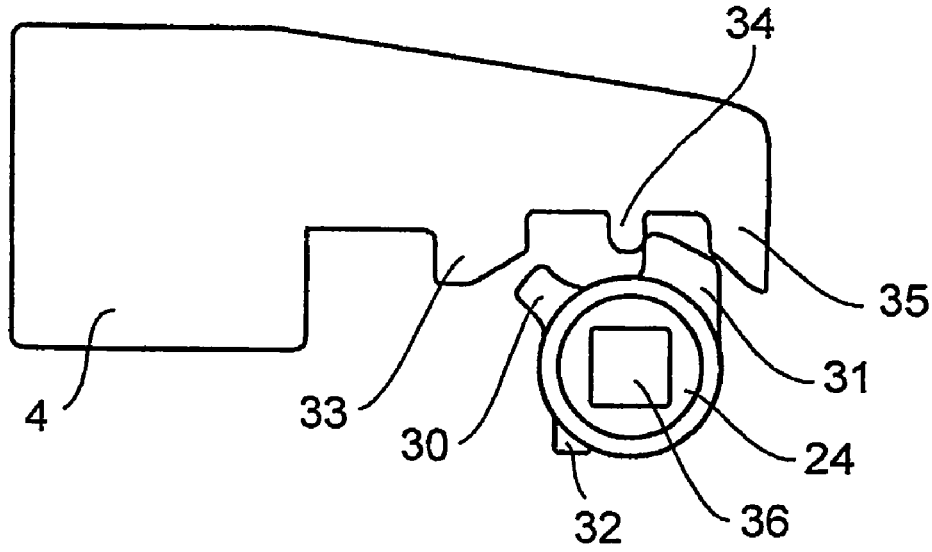
FIG. 6 is a view of the locking bolt and associated nut in the extended position of the locking bolt.

The schematic diagrams of FIGS. 5 and 6 show the locking bolt 4 with the nut 24. Whereas the locking bolt 4 has traveled into the hardware fitting 1 in the diagram according to FIG. 4, FIG. 6 shows the locking bolt 4 after it has traveled out of the fitting. i.e., in an extended position.

On the locking bolt 4 there is a tailpiece 38, on which a driver 33 and a driver 34 are formed. In addition, a stop 35 is also present on the tailpiece 38. In the "open position", i.e., the retracted position of the locking bolt 4, shown in FIG. 5, a stop 32, which is present on the nut 24, rests against the driver 33. This prevents the locking bolt 4 from moving any further inward when one tries to further rotate the nut 24. When the nut 24 is now turned to the left in FIG. 5, the driver 30 of the nut 24 engages in the first stage, that is, the driver 30 contacts the driver 33 of the tailpiece 38 and thus moves the locking bolt 4 out of the fitting 1 and into its locking position or extended position. After the driver 30 is no longer in contact with the driver 33, the driver 31 of the nut 24 comes to rest against the driver 34 of the tailpiece 38. Because the driver 31 has a rounded external contour and is wider than the driver 30, the driver 31 also comes to rest against a stop 35 of the tailpiece 38. Thus it is no longer possible for the locking bolt 4 to travel any farther outward. At the same, time, however, this position of the nut 24 ensures a self-locking of the locking bolt 4 against unintentional travel in the reverse direction.

What is claimed is:

1. A hardware fitting for an all-glass door, comprising:

a first fitting half arrangeable on an outer side of the door;

a second fitting half arrangeable on an inner side of the door and opposing said first fitting half;

an actuatable nut arranged between said first and second fitting halves;

a lock having a locking bolt and arranged between said first and second fitting halves, said locking bolt being slidable between a retracted position and an extended position in response to a movement of said nut; and a door stop integrated into at least one of the first and second fitting halves, wherein said first and second fitting halves are designed as knobs, each of said knobs having an end surface facing away from the other of said knobs, said end surfaces being slanted such that the end surfaces are not perpendicular to a longitudinal axis of said knobs, said slanted end surface of said at least one of the first and second fitting halves being part of the door stop, and wherein said knob of said at least one of said first and second fitting halves comprises an upper knob part and a lower knob part, said lower knob part being made of a material having a lower Shore hardness or being coated with the material having a lower Shore hardness than said upper knob part.

2. The hardware fitting of claim 1, each of said first and second fitting halves has a plate facing the other of said first and second fitting halves and extending laterally on at least one side of said each of said first and second fitting halves.

3. The hardware fitting of claim 1, wherein the hardware fitting is arrangeable on doors of baths, showers, and changing rooms.

4. The hardware fitting of claim 2, further comprising a display device arranged in said plates and indicating a state of occupancy relative to a position of said locking bolt.

5. The hardware fitting of claim 4, wherein said display device selectively displays an "unoccupied" state and an "occupied" state in the form of color-coded display fields.

6. The hardware fitting of claim 1, wherein one of said first and second fitting halves is fixed in position and the other of said first and second fitting halves is rotatable, and wherein said rotatable one of said first and second fitting halves is connected to said nut for actuating said locking bolt.

7. The hardware fitting of claim 1, wherein one of said first and second fitting halves has at least one recess in its outer contour.

8. The hardware fitting of claim 1, wherein said first fitting half has a central bore leading to said nut, said hardware fitting further comprising a connecting mandrel which passes through said central bore and acts on said nut.

9. The hardware fitting of claim 8, further comprising an emergency opening device connected by the connecting mandrel to said nut, wherein said emergency opening device is actuatable for retracting said locking bolt.

10. The hardware fitting of claim 6, further comprising a driver connected to said nut and receiving said second fitting half, and a locking screw for fixing said second fitting half to said driver.

11. The hardware fitting of claim 1, wherein said material having a lower Shore hardness comprises one of rubber and a material exhibiting characteristics of rubber.

12. The hardware fitting of claim 1, wherein said lower knob part extends approximately as far as a center of said end surface of said second fitting half.

13. The hardware fitting of claim 1, wherein said upper and lower knob parts of said second fitting half are round.

14. The hardware fitting of claim 1, wherein said lower knob part comprises radial projections.

15. The hardware fitting of claim 1, wherein said first and second fitting halves are centered relative to each other by locating pins and connected to each other by a locking screw.

16. The hardware fitting of claim 1, wherein said nut comprises two drivers and a limiting stop for actuating said locking bolt in two stages.

17. The hardware fitting of claim 16, wherein said nut locks said locking bolt in the extended position.

18. The hardware fitting of claim 5, wherein said display fields are provided on said locking bolt.

19. The hardware fitting of claim 1, wherein said first and second fitting halves are made of one of brass, light metal, special steel, and plastic.

20. A hardware fitting for an all-glass door, comprising:

a first fitting half arrangeable on an outer side of the door;

a second fitting half arrangeable on an inner side of the door and opposing the first fitting half an actuatable nut arranged between the first and second fitting halves; and a lock having a locking bolt and arranged between the first and second fitting halves, the locking bolt being slidable between a retracted position and an extended position in response to a movement of the nut, wherein each of the first and second fitting halves is designed as a knob, each of the knobs having an end surface facing away from the other of the knobs, wherein at least one of the knobs comprises an upper knob part and a lower knob part, the lower knob part being made of a material having a lower Shore hardness or being coated with the material having a lower Shore hardness than the upper knob part, wherein the end surface of the at least one of the knobs comprises a first end surface on the upper knob part and a slanted second end surface which is on the lower knob part and extends outward from the first end surface in a direction further away from the other of the knobs so that the lower knob part is operable to function as a door stop.

* * * * *